United States Patent [19]

Ribeiro de Almeida

[11] 4,343,226

[45] Aug. 10, 1982

[54] ARRANGEMENT FOR HYDRAULIC PRESSES AND BENDING PRESSES

[75] Inventor: A. A. Ribeiro de Almeida, Porto, Portugal

[73] Assignee: Firma Inter-Hydraulik GmbH, Berneck, Switzerland

[21] Appl. No.: 56,254

[22] Filed: Jul. 10, 1979

[30] Foreign Application Priority Data

Jul. 11, 1978 [PT] Portugal ..... 68274

[51] Int. Cl.[3] ..... F01B 25/04; F15B 11/22

[52] U.S. Cl. ..... 91/171; 91/207; 91/209; 91/520; 92/108

[58] Field of Search ..... 91/171, 520, 207, 208, 91/209; 92/108

[56] References Cited

U.S. PATENT DOCUMENTS

| | | | |
|---|---|---|---|
| 513,493 | 1/1894 | Evered | 91/207 |
| 2,346,254 | 4/1944 | Ernst | 91/209 |
| 2,940,262 | 6/1960 | Pfitzenmeier | 91/520 |
| 3,059,431 | 10/1962 | Munschauer, Jr. et al. | 91/171 |
| 3,143,924 | 8/1964 | Pearson et al. | 91/171 |
| 3,186,305 | 6/1965 | Lorimer | 92/108 |
| 3,349,669 | 10/1967 | Richardson | 91/171 |

FOREIGN PATENT DOCUMENTS

| | | | |
|---|---|---|---|
| 336263 | 3/1959 | Switzerland | 91/207 |

*Primary Examiner*—Paul E. Maslousky
*Attorney, Agent, or Firm*—James E. Nilles

[57] ABSTRACT

In a press with two parallel, spaced apart multiple-acting cylinders that have their respective pistons connected to end portions of a beam to which a bending or forming tool is secured, the cylinders are respectively fed from effectively separate pressure fluid sources providing equal pressures and flow rates. For synchronization of piston extension through an initial rapid advance, the chamber of each cylinder that is normally pressurized for retraction of its piston is connected in feedback relation to the pressure fluid source for the other cylinder, so that fluid expelled from a leading cylinder augments the fluid supply to the lagging one. The system further comprises a pair of sensors, one for each beam end, and a synchronizing bleed-off valve for each sensor. During the working portion of the extension stroke each sensor responds to the relative position of its beam end to impress control signals upon its associated synchronizing valve whereby fluid being charged into the cylinder at its beam end is bled off at the rate necessary to maintain exact piston synchronization; and at the end of the extension stroke the sensors cause full opening of both synchronizing valves for accurate stopping of the beam.

7 Claims, 12 Drawing Figures

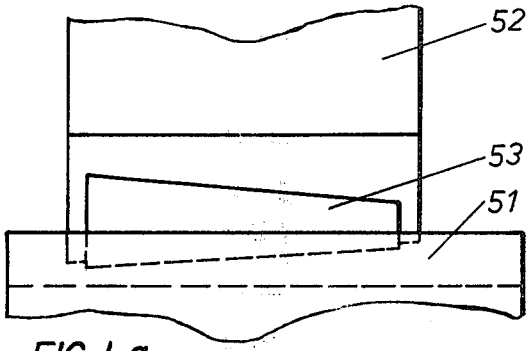
FIG. 1-a
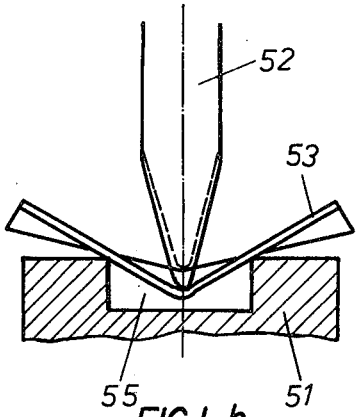
FIG. 1-b
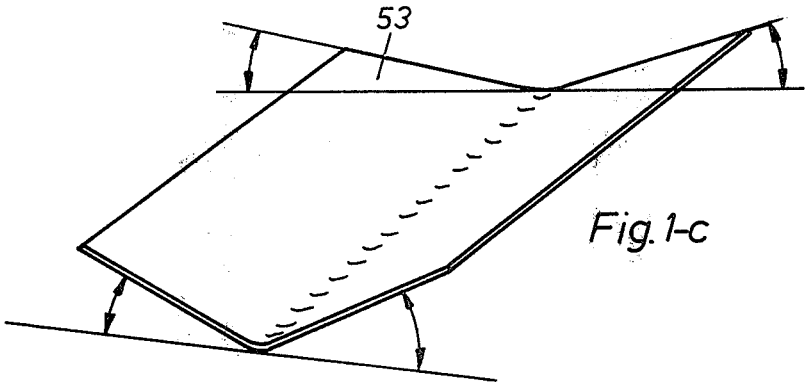
Fig. 1-c
Fig. 4
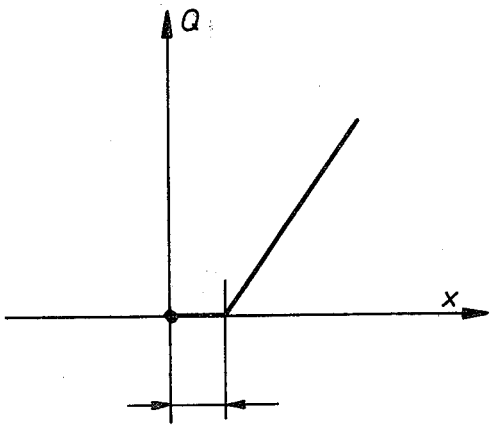

METERING VALVE
METERING VALVE

ARRANGEMENT FOR HYDRAULIC PRESSES AND BENDING PRESSES

FIELD OF THE INVENTION

This invention relates to hydraulic presses and bending presses that have at least two multiply working cylinders arranged on a machine frame and wherein the pistons of the cylinders mutually grip a beam upon which a bending or forming tool is secured; and the invention provides for attaining a synchronized movement of the pistons in such a press.

The field of the present invention is hydraulic presses and bending presses as well as other hydraulically operated machines which present the problem of effecting parallel guidance of a beam or the like that is actuated by the pistons of plural cylinders. The invention is also directed to the problem of achieving accurate stopping of piston propelled motion after accomplishment of the working strobe of a bending or forming tool, but that problem is not limited to hydraulic presses and bending presses and can also arise in other hydraulically actuated machines.

BACKGROUND OF THE PRIOR ART

In bending presses in particular, relatively long press beams with relatively long working strokes are often employed. In order to guide the elongated press beam in straight movement, it is secured in a known manner to the piston of each of two cylinders that are vertically arranged on the machine frame in spaced parallel relationship to one another. A geometrically similar arrangement is also often found in two-cylinder forming presses. With both types of machines, forming work is performed by a bending or a forming tool which is secured to the beam and which cooperates with a die on the machine table. When asymmetrical workpieces or press tools are employed, there may be exerted upon the beam an asymmetrical force which has a resultant that does not lie midway between the two cylinders on the machine frame, so that different opposing forces are imposed upon the pistons of the two cylinders.

An objective of the present invention is to cause the beam of a press or bending press having an arrangement of the type just described to be constantly guided in motion accurately parallel to the press table, even under the influence of asymmetrical forces.

With a bending press, the bending of the workpiece is obtained by causing the bending tool to ride into the free opening of a die arranged on the machine table. The bending angle of the workpiece is increased as the bending tool rides farther into the opening in the die. From this it can be seen that to obtain a given bending angle for the workpiece, it is essential to effect an arcuate stopping or arresting of the bending tool within the die opening.

An objective of the present invention, therefore, is to achieve in a hydraulic press or the like that has the above described arrangement both an exceptionally accurate parallel guidance of the beam and an exact stopping of the beam upon completion of the working stroke.

The objectives of the invention are thus directed to the solution of a three-fold problem having the following components:

(a) Maintaining parallelism of the beam in relation to the machine table during the feed advance which precedes the working part of the forward stroke;

(b) Exactly stopping the beam relative to the die on the machine table, at a particular desired position;

(c) Maintaining parallelism of the beam in relation to the machine table through the working portion of the forward stroke.

SUMMARY OF THE INVENTION

In general, the characterizing feature of the present invention that solves this problem is that the annular chamber in each cylinder that is charged with pressure fluid to effect its return stroke is hydraulically connected with an annular chamber in the other cylinder that is intended to be charged with pressure fluid during its advance, and vice versa, and that at least during the advance, pressure is maintained upon fluid in the annular chamber in each cylinder that is intended to be charged with pressure fluid for effecting the return stroke of the cylinder.

With this essential feature of the present invention, a parallel guidance of the parallel-working hydraulic cylinders is attained because if a greater opposing force is exerted upon the piston of one cylinder than upon the piston of the other, hydraulic fluid is displaced from the first mentioned cylinder into the second cylinder in such a manner as to assure an absolutely parallel guidance of the beam.

Because, in each cylinder, the annular rod end chamber that is intended to be pressurized for the return stroke of the piston is also subjected to pressure at least during the advance, there is attained an extraordinarily stable and exact guidance of the piston in each cylinder. Each piston is thus driven out against a hydraulic pressure which exists in the annular rod end chamber that would conventionally be pressurized only during the return stroke, and the working stroke is thus accomplished against an opposing force. Through this the pistons of the cylinders are extraordinarily precisely and accurately guided, and as a further result there is assured an absolutely accurate stopping of the pistons at the end of the working stroke. It is then only necessary to provide suitable arrangements of valves to relieve hydraulic pressure in the annular chamber that serves for effecting the advance, as can be accomplished very accurately with associated valve controls.

In part the solution to the problem hereinabove set forth resides in causing all of the multiply working cylinders that are arranged on a machine frame to be acted upon by one common hydraulic pressure. This hydraulic pressure can be provided either by a double pump (one pump having two like outlets), two coupled pumps, or one pump with a flow divider valve, thus satisfying a basic requirement for assuring synchronization of the parallel guided pistons.

In furtherance of the inventive concept, provision is made for an improved synchronization control of the beam, obtained by an error measurement and regulation system that is more fully described hereinafter. Through the combination of the means for maintaining parallelism of the beam with the error measurement and regulation system, there is attained a previously unrealized degree of synchronization of the beam.

Due to the parallel connection of the annular chambers of the cylinder in accordance with this invention, there is always imposed upon the piston, through the rapid feed advance and the working stroke, an opposing force that is greater than the weight of the beam itself, including the interchangeable tool secured thereto. By reason of this connection, in cooperation with valve controls to be more fully described hereinafter, there is afforded an absolutely precise stopping of the beam and in consequence thereof an accurate bending angle of the workpiece to be bent.

According to the invention, there are employed simple two-port two-way valves (one inlet and one outlet opening) which are closed when in a normal position and which open with a progressive through-flow characteristic. The control of these valves is suitably accomplished by means of a progressively operating control mechanism, in order to apportion oil to the tank from a leading cylinder on the basis of its small existing load. Inasmuch as an opposing force is steadily exerted upon the piston all during the rapid feed advance and the working portion of the forward stroke, there results a very accurate stopping, especially by reason of a prompt and complete diversion of feed flow away from the cylinders upon termination of the forward stroke.

There is afforded hereby an inexpensive and very simple control that is superior to heretofore known systems with respect to cost and accuracy.

A further noteworthy feature of the present invention is that its error measuring and regulating system—which can be either mechanical or electronic—enables the beam to be established and maintained in a desired slanting position.

In consequence of the high forces that attend bending press operation, it is known that the machine frame is exposed to deforming forces that can result in an elongation of the machine frame and its lateral posts. Further, with long continued use the bending tool is subjected to a steady wearing away. The machine frame deformation or the wearing away of the tool, or both of them, can be asymmetrical, but in any case the error measuring and regulating system according to the invention gives the machine operator the capability to set in an oblique position of the beam within certain angular limits, in order to compensate for the detrimental condition. The beam can thus be installed at such a slant as offsets deformation of the machine frame or one-sided wearing away of the bending or forming tool.

Further advantages and characteristics of the invention will appear from the drawings and the description of them and from the claims.

BRIEF DESCRIPTION OF DRAWINGS

In the following, the invention is explained more fully with reference to the accompanying drawings, which illustrate the invention by way of example and in which:

FIG. 1*a* is a side view and FIG. 1*b* is a sectional view through the work performing portion of a bending press with a workpiece therein, illustrating lack of parallelism;

FIG. 1*c* is a perspective view of the workpiece bent with an error in parallelism;

FIG. 4 illustrates the control characteristics of the synchronizing valve, showing how flow through the valve is dependent upon the mechanical displacement signal (control signal) applied to it;

DETAILED DESCRIPTION OF THE INVENTION

Figure 2:
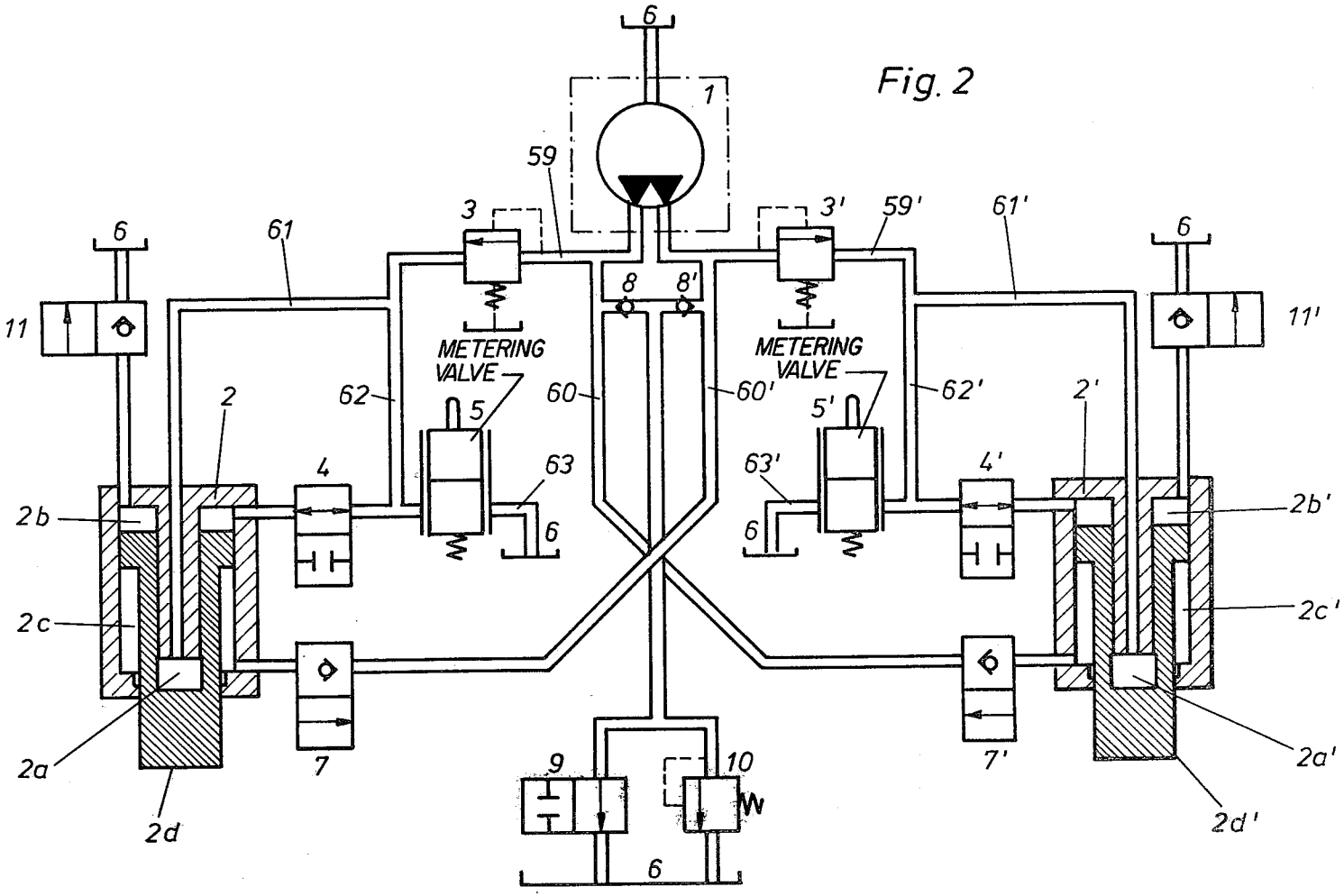
FIG. 2 is a schematic hydraulic circuit diagram for bending press apparatus that embodies the present invention, the bending press with its beam not being shown.

FIG. 1 shows how a punch or bending tool 52 enters into an opening 55 in a die 51 on a press table 54 (see also FIG. 6) to form a bend in a workpiece 53.

From the illustrations of FIGS. 1*a* through 1*c* it is clear that if the punch 52 extends obliquely to the die 51, as shown in FIG. 1*a*, instead of being parallel to the table 54, the workpiece 53 can be bent with an undesirable lack of symmetry in the manner shown in FIG. 1*c*. It will be further evident from the illustrations that the bending angle depends upon the entry distance of the punch 52 into the opening 55 in the die 51. The more accurately the stopping of the punch 52 takes place upon completion of the working stroke, the more accurately will the required bending angle of the workpiece 53 be attained.

In a press of the type with which the present invention is concerned, the punch or bending tool 52 is secured to a beam 16 (see FIGS. 5 and 9), and the pistons 2*d*, 2*d'* of cylinders 2, 2' are connected to the beam 16 near opposite ends thereof to actuate the beam up and down relative to the press table 54.

In an embodiment of the present invention, the hydraulic circuit shown in FIG. 2 is employed to control movement of the pistons 2*d*, 2*d'*, keeping them synchronized to maintain parallelism of the beam and bringing them accurately to a stop at the end of the working stroke. The hydraulic circuit of the bending press comprises a pump 1 with two outlets which deliver two oil flows that are equal, taking into account the variations of each of the outputs that originate from the volumetric efficiency and the compressibility of the fluid on the basis of the effective pressure. The two oil flows are taken by the pump from a tank 6. Through a duct 59, 59', each of the respective oil flows is conducted by way of a cut-off valve 3, 3' and a further duct 61, 61' to an inner chamber 2*a*, 2*a'* of one of the pair of triple-acting cylinders 2, 2'. A triple acting cylinder 2, 2' is selected for the purpose of obtaining a fast advance (rapid traverse) of the piston 2*d*, 2*d'* by means of the inner chamber 2*a*, 2*a'*.

Each of the cut-off valves 3, 3' is so arranged that it passes an oil flow only if its pressure exceeds a certain minimum value.

Branching from each of the ducts 61, 61' is a duct 62, 62', respectively, which is connected with the inlet of an electrically or otherwise controlled two-port two-way valve 4, 4'. Each of the two-way valves 4, 4' is normally in an open condition but is closed for the forward movement of the beam in order to cause admission of fluid to the inner chambers 2a, 2a' for a high velocity feed traverse.

In the hydraulic circuit, a synchronizing valve 5, 5' is branched from the inlet of each of the two-port two-way valves 4, 4', respectively. The synchronizing valves 5, 5', which are mechanically controlled as explained hereinafter, are closed under normal conditions, and when open each provides a progressive through-flow characteristic. These synchronizing valves 5, 5' have their respective outlets 63, 63' connected with the tank 6, and they function as bypasses for the ducts 62, 62' that lead to upper annular chambers 2b, 2b' at the ends of the respective cylinders.

Each of the cylinders 2, 2' has a lower or rod end annular chamber 2c, 2c' which is connected with the particular output of the pump 1 that supplies fluid to the upper annular chamber 2b', 2b of the other cylinder 2', 2. The designations "upper" and "lower" annular chambers are referred to a press with pistons 2d, 2d' that move downwardly in their working strokes; but it will be understood that the invention is also applicable to presses with upwardly directed working strokes, so that what is here termed the upper annular chamber 2b, 2b' is, in more general terms, the blind end annular chamber that provides for the extension stroke, while what is herein designated as the lower annular chamber 2c, 2c' is the rod end chamber that provides for the return stroke of the piston 2d, 2d'.

Each lower annular chamber 2c, 2c' is connected through a check valve 7, 7' and a duct 60, 60' with the duct 59, 59' that leads from an outlet of the pump 1. In their normal positions the check valves 7, 7' block return flow towards the pump, and they have as their purpose the stopping of the beam 16 in its normal raised position so that it does not fall down under its own weight.

There is a further check valve 8, 8' in series with each of the ducts 60, 60' and an electrically or otherwise controlled change-over valve 9 that provides for simultaneous direct drainage of both oil flows from the pump 1 to the tank 6 when the beam is in its raised normal position. By-passed across the change-over valve 9 is a relief valve 10 that responds where there is attained in one of both of the check valves 8, 8' the maximum operating pressure for which the relief valve 10 is set.

There is a further connection between the tank 6 and each of the upper annular chambers 2b, 2b' of the cylinders 2, 2' by way of fill valves 11, 11' that permit suction withdrawal of oil from the tank 6 during the feed advance and also provide for a direct exhaust of oil from the upper annular chamber 2b, 2b' and the inner chamber 2a, 2a' of each cylinder 2, 2' during the return movement of its piston 2d, 2d'.

The control circuits for the valves are available within the state of the art that relates to hydraulic machines and therefore will not be described.

Instead of triple-acting cylinders 2, 2', double-acting cylinders could be employed, although with the absence of the inner chambers 2a, 2a', there would be a sacrifice of the rapid traverse or feed advance of the pistons 2d, 2d' which takes place during the portion of their forward stroke that precedes actual forming work. In any embodiment of the cylinders 2, 2', it is essential that the operative cross-section surface of the upper annular chamber 2b, 2b' be larger than the cross-section surface of the lower annular chamber 2c, 2c', to ensure that upon a simultaneous admission of equal hydraulic pressures to the upper and the lower annular chambers, a lesser force will be exerted upon the pistons 2d, 2d' from the sides of the lower annular chambers 2c, 2c', so that they will move in the working stroke direction against a hydraulically produced opposing force.

Figure 3:
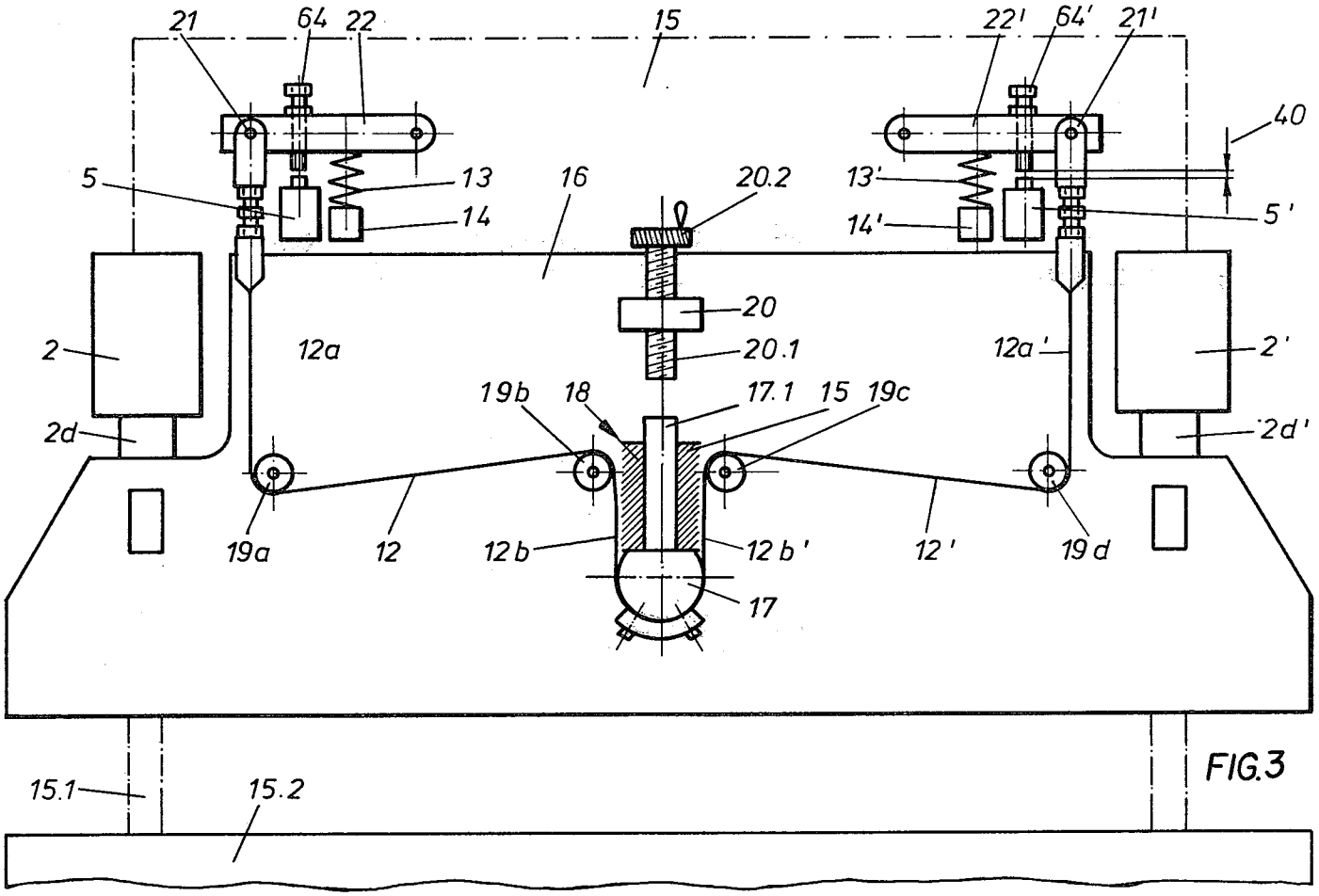
FIG. 3 schematically illustrates the mechanical error measuring and regulating system of this invention.

From FIG. 2 taken with FIG. 4 it will be apparent that the synchronizing valves 5, 5' are responsible for maintaining parallel excursions of the pistons 2d, 2d' and consequently for straight line movement of the beam 16. In the illustrated embodiment each of the synchronising valves 5, 5' is mechanically controlled, as for example by means of a stop dog as shown in FIGS. 3 and 4. In FIG. 4, the stream flow through a synchronizing valve 5, 5' is designated by Q, while X designates the mechanical movement signal (control signal) impressed upon the stop dog of the synchronizing valve 5, 5'.

From FIG. 4 it can be seen that, beginning at the zero point, increase in the mechanical movement signal X at first brings about no change (dead zone) in the through-flow stream. With further increase in the mechanical movement signal X to values above those for the dead zone, the through-flow stream increases proportionally to the mechanical movement signal. Each synchronizing valve thus comprises a known type of proportional metering valve such as is disclosed, for example, in U.S. Pat. No. 3,059,431 to Munschauer et al (particularly col. 1, lines 57–70; col. 3, lines 46–55; and the paragraph bridging cols. 3 and 4) and by U.S. Pat. No. 3,349,669 to Richardson (see FIG. 3, curve A and col. 4, lines 43–53; also col. 2, line 50 through col. 3, line 4).

Figure 5:
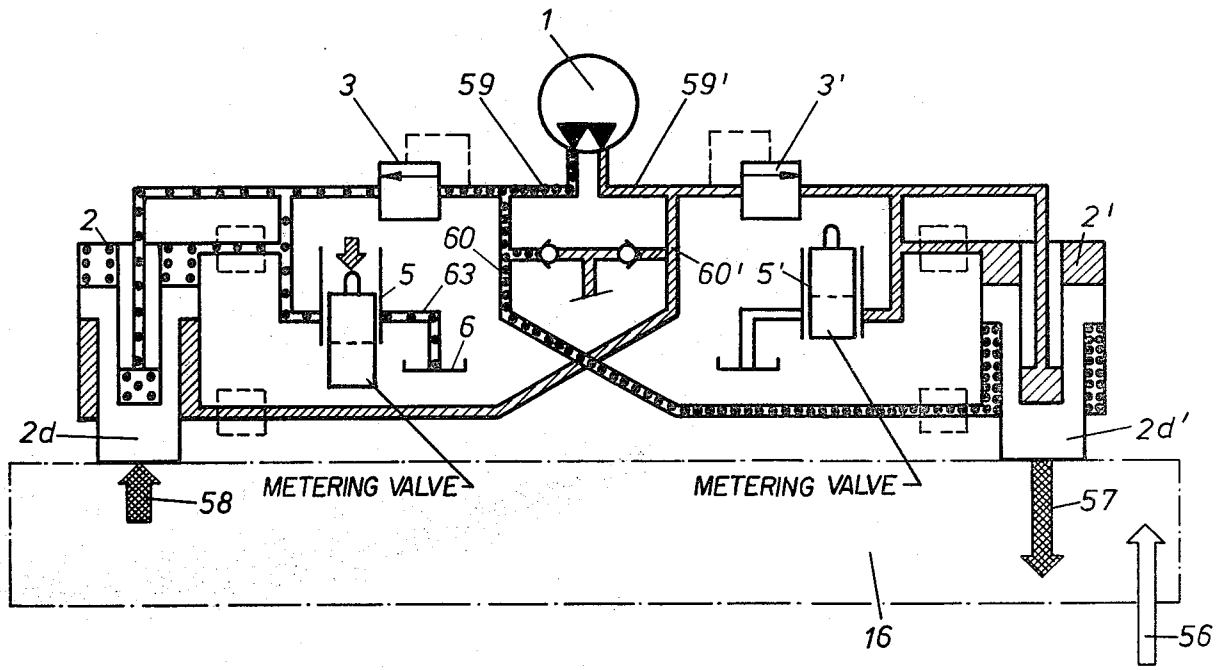
FIG. 5 shows pressure conditions in the hydraulic circuit according to FIG. 2 when there is an asymmetrical loading of the beam.

FIG. 5 shows the pressure conditions in the hydraulic circuit according to FIG. 2 when an asymmetrical force in the direction of the arrow 56 is exerted upon the beam 16. Different pressure values are denoted by different markings in the hydraulic ducts. The hatched marking signifies the presence of high pressure (working pressure) in the correspondingly marked ducts. In the ducts marked with closely adjacent dots, medium pressure predominates (as near the left cut-off valve 3). In the ducts marked with spaced apart dots there exists a reduced pressure due to throttling (as near the left synchronizing valve 5).

Since the upper annular chamber 2b' of the right-hand cylinder 2' has working pressure (high pressure) admitted to it, there is exerted upon the beam 16 by the piston 2d' of the cylinder 2' a large force in the direction of the arrow 57, opposing the force denoted by the arrow 56. This takes place in the following manner:

Since the duct 60' that leads from the duct 59' at the outlet of the pump is connected to the lower annular chamber 2c of the left cyliner 2, there is high pressure fluid in said lower annular chamber of said cylinder 2. There is thus produced a relatively large opposing force upon the left piston 2d, so that said piston 2d tends to retract in the direction of the arrow 58. At the same time, there is a decreased pressure in the upper annular chamber 2b of the left cylinder 2, due to an effective throttling produced by the left synchronizing valve 5 as it diverts oil flow to the tank 6 by way of the duct 63. By reason of the opening of the left synchronizing valve 5, the through-flow acrosss the left cut-off valve 3 is so controlled by said cut-off valve that in the duct 59 ahead of it there is only medium pressure, which arrives at the lower annular chamber 2c' of the right cylinder 2' by way of the duct 60.

From the illustration it will be clear that the left synchronizing valve 5 has received a control signal according to the arrow shown at it, which produces the above described pressure conditions. The production of the control signals will now be further explained with reference to FIG. 3.

Figure 9:
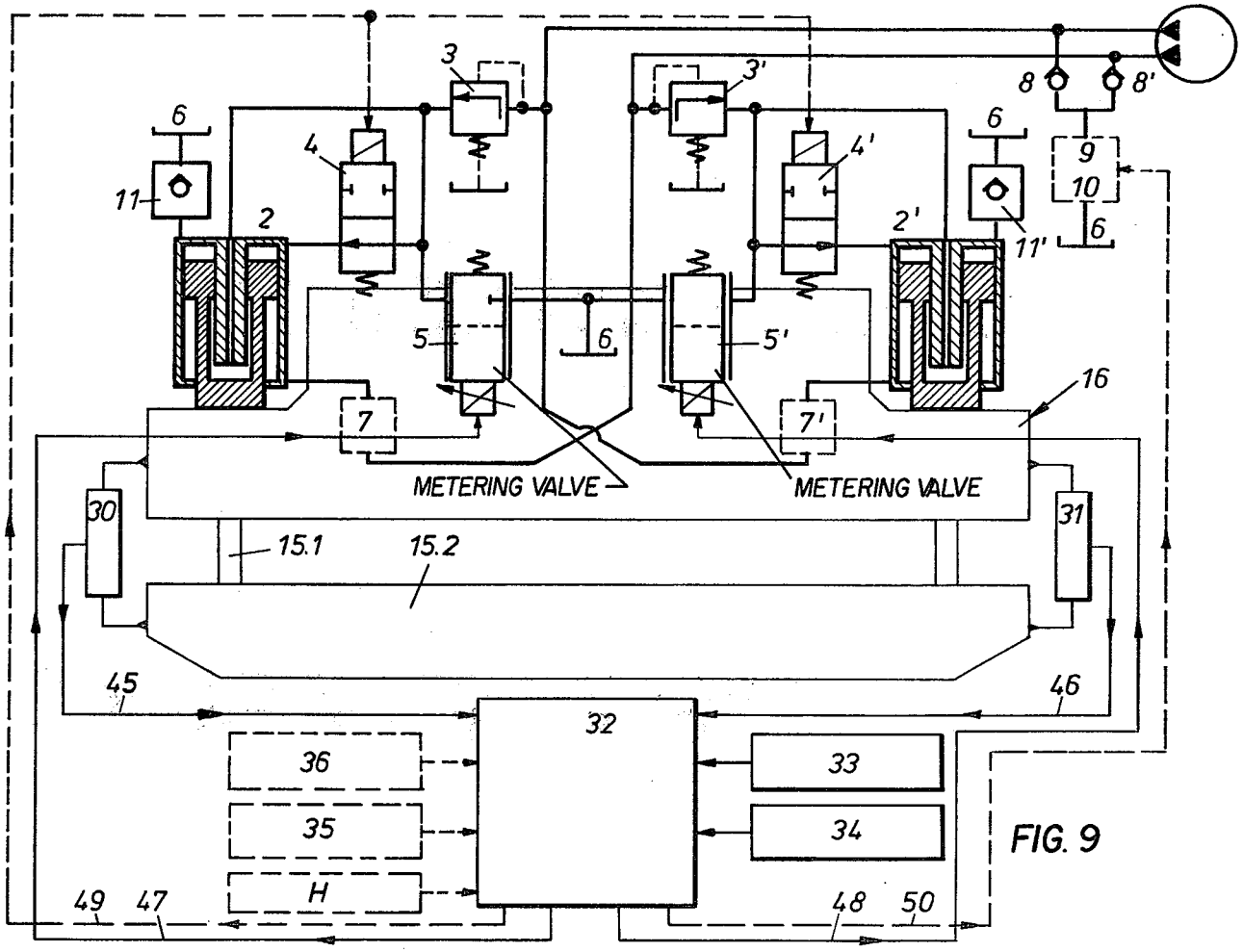
FIG. 9 is a schematic diagram of an electronic error measurement and regulation system which can replace the error measurement system according to FIGS. 3 and 7.

FIG. 3 shows an embodiment of a mechanical error measurement and regulation system which can be replaced by a similarly operating electronic system according to FIG. 9.

The system shown in FIG. 3 comprises two inelastic elongated tension elements 12, 12', for example steel bands or steel cables, each having one end fastened to a securement point 21, 21' on the free end of a lever 22, 22' that is swingably mounted on the machine frame 15. By means of a spring 13 each lever 22, 22' is biased away from its securement point 14, 14' and away from an associated synchronizing valve 5, 5' that is located beneath it. On the swingable part of each lever 22, 22' there is arranged a stop dog 64, 64' which actuates the stop dog of its associated downwardly adjacent synchronizing valve 5, 5'.

Extending out from the securement points, the tension elements 12, 12' run over rollers **19*a*–19*d* which are rotatably mounted on the beam 16. Beginning at its securement point 21, 21', each tension element 12, 12' has a first stretch portion 12*a*, 12*a'* that extends parallel to the direction of movement of the beam 16 and to a roller 19*a*, 19*d* at which it makes a turn; and beyond that roller it has a nearly horizontal stretch portion which extends to a further roller 19*b*, 19*c* around which it makes an opposite turn into another stretch portion 12*b*, 12*b'*** that runs parallel to the direction of movement of the beam.

At its end remote from the lever 22, 22', each of the tension elements 12, 12' is secured to a slider 17 that is slidably mounted on the machine frame 15 by means of guides 18.

Because of the construction of the described system, the tension elements 12, 12' are tensioned and the slider 17 is held on the base of the guide 18 by the lever biasing springs 13, 13', which can be dished springs (Belleville), helical springs, spring rods or the like.

The error measurement system is completed by an abutment device 20 that is secured to the beam 16 and is adjustable therethrough, comprising a nut through which a threaded spindle 20.1 extends. The spindle 20.1 is rotatable by means of a hand wheel 20.2 thereon and is thus adjusted along its length relative to the nut and the beam 16. The front lower end of the threaded spindle 20.1 comprises an abutment that cooperates with the bolt 17.1 of the slider 17.

As soon as the abutment 20 engages the bolt 17.1 of the slider 17, due to the movement of the beam 16, the tension elements 12, 12' are lengthened against the force of the springs 13, 13', so that the stop dogs 64, 64' that are arranged on the levers 22, 22' actuate the associated stop dogs of the synchronizing valves 5, 5'.

During an advancing movement of the beam 16 there are two possibilities. Either the beam 16 runs parallel, or it swings during the downward stroke.

In the first case, the axes of the rollers **19*a*, 19*d* of the tension elements 12, 12' remain at equal distances from the pivot axes of levers 22, 22', and the lengthening of the outer vertical strength portions 12*a*, 12*a'* of the tension elements corresponds to the shortening of the middle stretch portions 12*b*, 12*b'*; hence the securement points 21, 21' of the tension elements 12, 12' do not move. However, should the beam 16 take up a slanting position, then the line through the axes of the outer rollers 19*a*, 19*b* of the tension elements comes into a slanting position, and accordingly the outer stretch portion 12*a* or 12*a'* on the side of the leading roller must lengthen itself, and the one on the opposite side at the following roller, must shorten itself. Since the tension elements 12, 12' in themselves are practically inelastic, a pull is exerted on the securement points 21, 21' for the tension elements 12, 12', effecting swinging displacement of one or both levers 22, 22' and thus causing a repositioning of the securement points 21, 21' of the tension elements 12, 12' and hence of the corresponding stop dog 64, 64'. This signals to the synchronizing valves 5, 5' the slanting position of the beam 16** at any arbitrary position in the termination zone.

If the adjustable abutment 20 that is built onto the beam strikes the bolt 17.1 of the slider 17 during the advancing movement of the beam 16, the slider 17 is thereby put in motion and draws out the tension elements 12, 12'. Through this there is not only signaled to the synchronizing valve 5 an evidently slanted position of the beam 16 but also a cut-off point at an arbitrary position of motion of the beam, and that cut-off point is dependent upon the adjustment of the head 20 in its connection with the threaded spindle 20.1.

BEHAVIOR OF THE HYDRAULIC CIRCUIT

1. Rapid Feed Advance (Traverse of the Beam 16)

If the control network is set for rapid feed advance (traverse) by closing the change-over valve 9, opening the check valves 7, 7', and maintaining the two-way valves 4, 4' closed, then the delivered flow of the pump 1 is fed into the inner chambers **2*a*, 2*a'* of the cylinders 2, 2'. According to an important feature of the invention, the cross-section of the inner chamber 2*a*, 2*a'* of each cylinder is larger than the cross-section of its lower annular chamber 2*c*, 2*c'*, and ecah piston 2*d*, 2*d'* can therefore extend while hydraulic fluid is drawn by suction into each of the upper annular chambers 2*b*, 2*b'*, directly from the tank 6, through the fill valves 11, 11'. The beam 16 is thus set in motion by the oil flow coming from the pump 1, at a velocity determined by the oil flow from the pump and the difference between the operative cross-section surfaces of the inner chambers 2*a*, 2*a'* and the lower annular chambers 2*c*, 2*c'* of the cylinders 2, 2'**.

In the event that the two oil flows through the ducts 59, 59' from the pump 1 are equal, the cylinders 2, 2' are also alike, and the entire hydraulic circuit is of symmetrical form, the two pistons **2*d*, 2*d'* of the cylinders 2, 2' move out with equal velocities during the advancing motion (traverse) of the beam 16, so long as no forces operate on the beam 16** that impel it to a slanting position by reason of a one-sided loading.

The hydraulic system itself effects a reduction of any error that tends to cause slanting movement because, due to the special connections according to the invention, a somewhat slanting or unsymmetrical loading of the beam is compensated for as explained in the description of FIG. 5. When, for example, the piston **2*d*, 2*d'* of one of the cylinders runs ahead, then there is an increase in the oil flow displaced by it out of the lower annular chamber 2*c*, 2*c'* of its cylinder. This displaced oil flow is led into the upper annular chamber 2*b'*, 2*b* of the other cylinder, so that the piston 2*d'*, 2*d*** of that other cylinder is driven faster until such time as both pistons move at the same rate.

If the slanting position of the beam 16 should persist during the rapid advancing motion, then such a slanting position is picked up according to the description of FIGS. 3, 4 and 5 by the there-described error measurement system, wherein the upper attachment point 21 or 21' of the respective flexible tension element 21, 21' on the leading end of the beam actuates the mechanical control of the synchronizing valves 5, 5' in order to accomplish a controlled runoff 63 or 63' to the tank 6, whereby the velocity of the leading cylinder is reduced and equality of movement is again produced.

With respect to the construction of the synchronizing valves 5, 5', they should have a control resolution such that small slanting positions of the beam do not lead to an engagement of the regulating system according to the invention. The bending or pressing function is not impaired by this during the rapid advancing movement, and the dynamic stability of the system is favored instead. Such control resolution can be obtained according to the description and the showing in FIG. 4 with the employment of seating valves as synchronizing valves, by leaving a free space 40 according to FIG. 3 between the mechanical control element of the valve and the mechanism of the error measurement system. There results from this a dead play of the valve, as FIG. 4 more fully illustrates.

2. Working Stroke of the Beam

When the beam 16, set in motion through the rapid advancing motion, passes a point that has been preselected by the operator—such preselection can be accomplished for example by means of an adjustable mechanically actuated electric switch—then the two-port two-way valve 4, 4', which directs the oil flow from the pump 1 to the upper annular chamber 2*b*, 2*b'* of each of the cylinders 2, 2', is brought to its normal rest position, which is its open condition. Thereafter like pressures exist in the inner chamber 2*a*, 2*a'* and in the upper annular chamber 2*b*, 2*b'* of each of the cylinders 2, 2', and the said chambers are fed with an oil flow which is a combination of the flow from the pump 1 and the oil flow escaping from the lower annular space 2*c*, 2*c'* of the opposite cylinder. Due to the increase of the effective surface in each cylinder 2, 2', the feed advance velocity decreases proportionally and in inverse ratio and converts to the working velocity.

During the working portion of the stroke, as already described, any slanting position is detected by the error measurement system described in FIGS. 3–5, and in the event of a slanting position it actuates the corresponding engaged synchronizing valve 5, 5' on the leading side; through this oil is exhausted to the tank through the outlet 63 or 63'. In this manner the smaller available oil flow of the other cylinder 2 or 2' is compensated for, due to the decrease of volumetric efficiency and the compressibility of the oil.

An eccentric force that acts upon the beam 16 by reason of the placement of the workpiece 53 in the die 1 is compensated for according to the invention by the cooperation of the error measurement system with the hydraulic circuit according to the invention. Thanks to the circuitwise connection of the upper and lower annular chambers 2*b*, 2*b'* and 2*c*, 2*c'* of the cylinders 2, 2' in relation to the outlets of the pump 1, the high working pressure in the upper annular chamber 2*b* or 2*b'* of the too-heavily-loaded cylinder 2, or 2' is led off to the lower annular chamber 2*c'* or 2*c* of the other cylinder 2' or 2, so that an opposing force is obtained. In this connection, reference is made to the above description of FIG. 5.

3. Accurate Stopping of the Beam 16

When the adjustable abutment 20 that is installed on the beam 16 is moved onto the bolt 17.1 of the slider 17 by the threaded spindle 20, the slider 17 is thereby moved downwardly in the advancing direction of the beam 16. (See FIG. 3). Through this a tension is imposed upon the tension elements 12, 12' which acts against the biasing force of the springs 13, 13'. These springs yield so that the respective lever 22 or 22' swings about its pivot point and the stop dog 64 or 64' mounted on the lever actuates the corresponding stop dog of the synchronizing valve 5 or 5'. Through this the oil flow is conducted to the tank 6 through the outlets 63, 63' by both synchronizing valves equally, and the oil flow that is released through the outlet 63, 63' is the greater as the slider 17 moves farther down in its guide 18 and as the tension elements 12, 12' are more stressed in tension and swing the levers down against the force of the springs 13, 13'. The beam 16 is finally stopped as soon as the oil flow escaping through the outlet 63, 63' corresponds with the delivery flow of the pump 1 through the ducts 59, 59'.

An equilibrium of the beam 16 results automatically, since the openings in the sychronizing valves 5, 5' are automatically so matched that the forces produced by the pressures acting upon the upper annular chambers (inner chamber 2*a*, 2*a'* and upper annular chamber 2*b*, 2*b'*), when added to the forces that exist by reason of the pressure in the lower annular chambers 2*c*, 2*c'*, provide a collective resultant for the working force and the weight of the beam 16 itself that has the value zero.

During the hydraulic stopping of the beam 16 by actuation of the sychronizing valves 5, 5', the error measurement and regulation system according to the invention, which comprises the synchronizing valves 5, 5', continues to function for correction of any slanted position of the beam. The sensitivity of the system is in fact increased, since the control resolution of the synchronizing valves 5, 5' is greatly exceeded.

4. Return Movement of the Beam 16

For the return movement of the beam 16 the following control procedures are accomplished in the hydraulic circuit:

The changeover valve 9 remains closed; the two-port two-way valves 4, 4', which control the feeding of the upper annular chambers 2*b*, 2*b'* of the cylinders 2, 2', remain open; the check valves 7, 7' at the lower annular chambers 2*c*, 2*c'* of the cylinders 2, 2' are brought to their normal rest positions, which is the position in which oil flow is freely admitted to the associated chambers but escape is prevented; and the fill valves 11, 11' are fully opened.

Since the inner chambers 2*a*, 2*a'* and the upper annular chambers 2*b*, 2*b'* are connected with the tank 6 and are no longer under pressure, and since the cut-off valves 3, 3' are adjusted for a higher pressure than is necessary for the lifting of the beam 16, the equal oil flows that come from the pump 1 are entirely directed to the lower annular chambers 2*c*, 2*c'* of the cylinders 2, 2' and thus effect the return of the pistons 2*d*, 2*d'* and the beam 16 with which they are mechanically connected.

To increase the security of hermetic sealing of the cut-off valves 3, 3', auxiliary means can be employed such as two-port two-way valves connected in series with them that open during the whole feed advance and are held in a normally closed position during the return and retention. In this manner the oil throughflow can be prevented from rising above the value for which the cut-off valve is adjusted as a consequence of any possible pressure rise such as can develop during return of the beam when special bending tools or drawing tools are employed that demand a greater press-opening force.

During the return of the beam 16, the error measurement system and the synchronizing valves 5, 5' are out of operation, since the inflow and outflow openings are connected with the tank 6.

The parallel movement of the beam 16 during the return depends only upon the character of the hydraulic system, and since no work is performed during the return, the beam never arrives at a critically slanting position. Any error that might arise from unlike piston movements will be directly corrected during the next advancing movement.

The error measurement system shown in FIGS. 3–5 can be replaced by an error measurement system according to FIG. 9. Such an electronic error measurement system must perform the following functions:

A program control is provided, merely for programming the exact stop required, since in a known manner the termination point of the punch in the die specifies the bending angle. According to the illustration in FIG. 9, the hydraulic system that is shown for example in FIG. 2 is combined with the following described electronic error measurement and regulation system.

The electronic error measurement system carries out the same functions as the previously explained mechanical error measurement system. The construction elements will not be further detailed since these belong to the state of the art and are not subject matter of the present invention.

Between the beam 16 and the support 15.2 which is connected through the supporting feet 15.1 with the upper portion of the machine frame, electrical distance measuring feelers are arranged on each side of the beam. The signal from these electrical distance feelers 30, 31 is transferred by way of signal conductors 45, 46 to a central processing unit 32. The signals for the detected position and the slant position of the beam 16 that are delivered through the leads 45, 46 from the electronic system must be manifested to the synchronizing valves 5, 5' by means of suitable elements such as, for example, proportionally driven magnets, linear servo-motors, etc.

The synchronizing valves 5, 5' with progressive throughflow characteristics comprise merely a covering edge and, as already mentioned, allow a full flow to pass at the time when the machine demands the highest precision from them, that is, during hydraulic stopping. Through this an optimum sensitivity (hysteresis, resolution) is obtained, since the dead zone more fully described in connection with FIG. 4 is then greatly exceeded. The aforesaid system is technically and economically more advantageous than a classical construction of the hydraulic circuit since, with the latter, four motion-proportional movable valves or servo-valves must be employed.

The central processing unit 32 receives and further processes signals from a hydraulic stop control 33, a slanting position control 34, a control for the upper lift limit 35, a control for velocity changeover 36 and a pump output and pressure limiting unit 37. The outputs of the central processing unit 32 that are produced in response to these inputs are impressed upon the signal leads 47, 48, 49, 50. The synchronization valves 5, 5' are acted upon by way of the signal leads 47 and 48, while the switching and pressure limiting valves 9, 10 are acted upon by way of the signal leads 49, 50.

SLANTING POSITION ADJUSTMENT OF THE BEAM 16

In accordance with the description given in the introduction, a desired slanting position of the beam 16 can be established by the operator in order, for example, to compensate for one-sided wearing away of the tool or distortion of the supports 15.2 or the frame feet 15.1 of the machine frame 15. In this connection reference is made to FIG. 6 of the drawings. Inasmuch as large forces are employed with bending presses, as is known, for forming workpieces 53, the machine frame 15, particularly the lateral supports 15.2, can be deformed in vertical planes. The forces exerted by the hydraulic pistons *2d, 2d'* upon the press table 54 must likewise be taken up from the frame feet 15.1. The order of magnitude of these vertical extensions, depending upon the size of the machine and the manufacturer's design, is between 0.5 and 1.5 mm.

With bending or press work in which symmetrical force divisions operate, the forces taken up by the supports 15.2 are equal, so that equal deformations also occur, and the precision of the bending procedure is not impaired; but to compensate for such forces the depth of entry of the press tool (punch 52) into the opening in the die 51 must be slightly changed.

Figure 6:
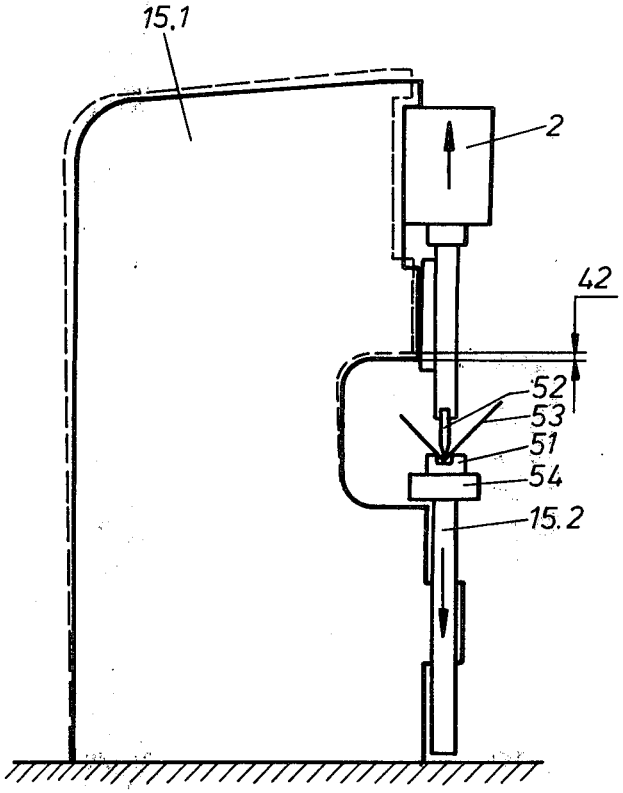
FIG. 6 is a schematic side view of a bending press machine frame, with deformation of the machine frame due to working forces indicated in broken lines.

When, however, asymmetrical forces are transferred to the press frame, for example according to FIG. 5, then each frame deforms itself differently with respect to the stretching distance 42 according to FIG. 6. As a result, the upper portion of the machine takes on a slanting position in relation to the bottom part, and in consequence the beam 16 also runs at a slant in relation to the table 54, so that an unacceptable error in parallelism is imparted to the workpiece in bending.

Further, the bending tool is in time worn away, and inasmuch as this wearing away does not extend uniformly over the entire workpiece, this gives rise to parallelism errors that are likewise unacceptable.

Also, the thickness of the particular workpiece that is to be bent may be irregular, so that further errors in parallelism result from this.

In order to preclude the disadvantageous effects of the above enumerated three effects, a selected and adjustable slanting position of the beam 16 is possible. This correction can be accomplished by the operator during the working procedure, hence when the machine is under pressure and at the stroke limit, so that the operator can supervise the correction optically or with the aid of a template.

Figure 7:
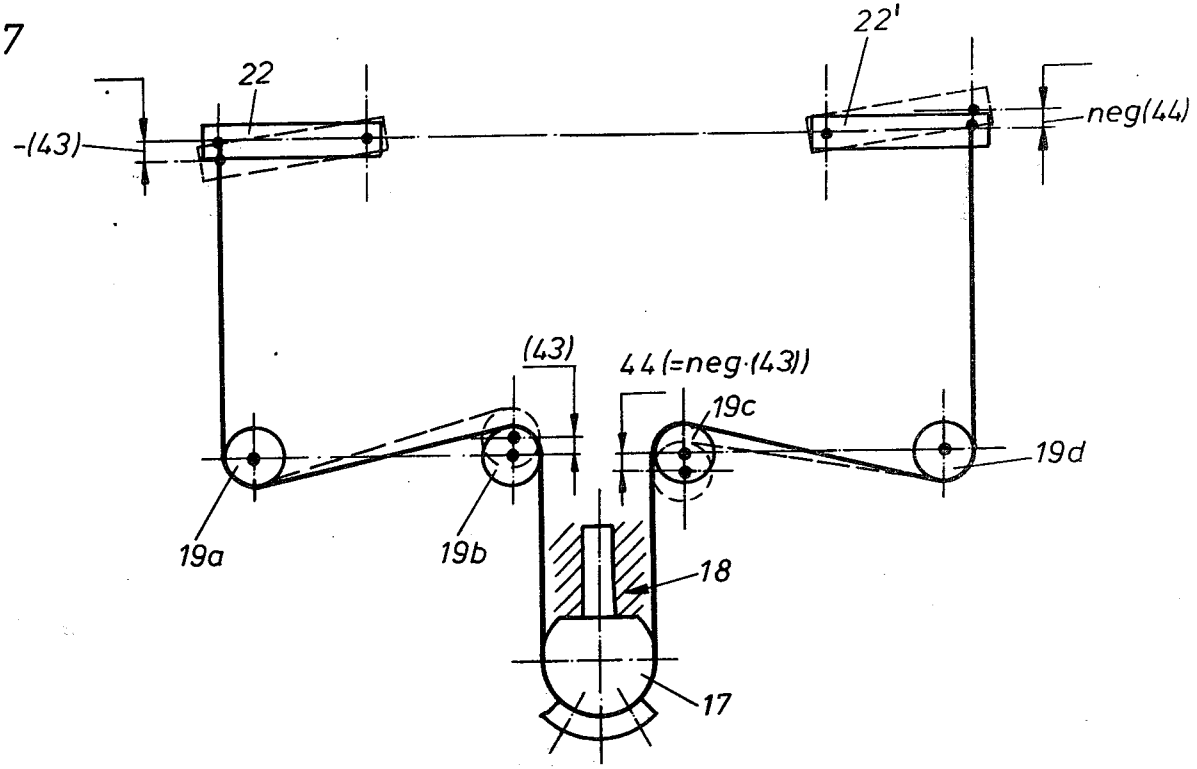
FIG. 7 is a sectional schematic view of the analog error measuring system according to FIG. 3, illustrating its adjustability.

The correction is carried out by reason of the central rollers *19b, 19d* being mounted adjustably on their axes as shown in FIG. 7. The axes of the rollers *19b, 19c* can for example be displaced through the offset distances 43, 44, of which the offset distance 44 is the negative value of the offset distance 43. As a consequence of this, the free ends of the levers 22, 22' are adjusted through the offset distances 43, 44. This control or correction command is transmitted by way of the actuating mechanism described in connection with FIG. 3 to the synchronizing valves 5, 5', which are then correspondingly controlled.

If the beam 16 is at its lower stroke limit and both of the synchronizing valves 5, 5' are actuated, then by reason of such offset adjustment one of the synchronizing valves is provided with a larger throughflow opening (negative offset distance 43) and it effects a pressure decrease in the corresponding cylinder 2 or 2'.

Under the pressure that prevails in the lower annular chamber 2c or 2c', the piston 2d or 2d' rides back until the synchronizing valve 5 or 5' is again brought to its initial opening condition; the other synchronizing valve 5 or 5' provides a smaller throughflow opening (positive offset distance 43), which diminishes the exhaust flow; through this the other piston 2d' or 2d is moved forward until, likewise, the original opening condition of the synchronizing valve 5' or 5 is attained.

Various construction embodiments can provide for such a selected slanted positioning of the beam 16.

Figure 8A:
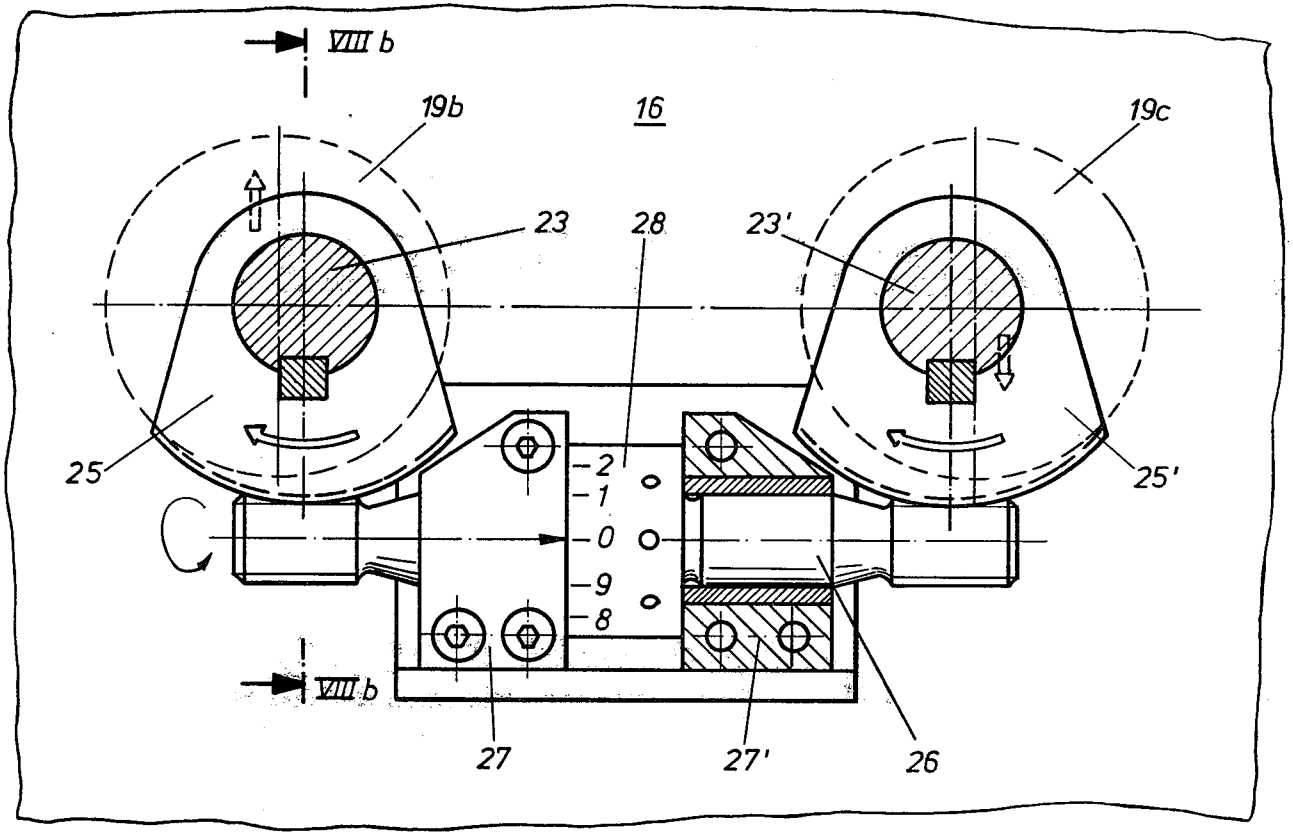
FIG. 8*a* is a sectional schematic view of the central guide rollers and the adjustment mechanism for the central guide rollers in the error measurement system according to FIGS. 3 and 7.
Figure 8B:
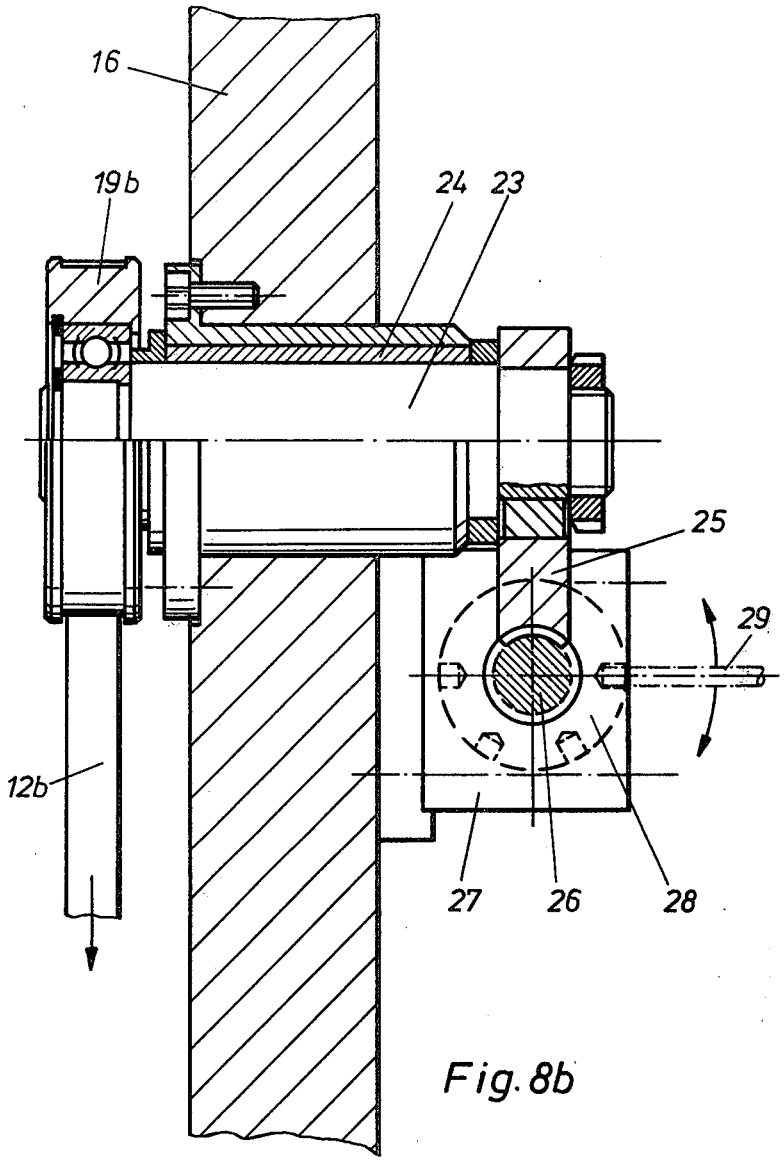
FIG. 8*b* is a sectional view taken on the line VIIIb—VIIIb in FIG. 8*a;*

In the embodiment example according to FIGS. 8a and 8b, in connection with FIG. 7, the central rollers 19b and 19c are mounted on eccentric axles 23, 23', and in turn the axles 23, 23', as best seen in FIG. 8a, run in bearings 24. Rotatable gear sectors 25, 25' are mounted on the beam 16, which engage in two worms 26 with a common shaft 27, 27'. The shaft 27, 27' is in turn rotatably mounted on the beam 16 by means of plain bearings, ball bearings or needle bearings. A drum 28 is mounted on the shaft 27, 27' for actuating the eccentric axles 23, 23', and the drum 28 can either be rotated directly or, for increased sensitivity, by insertion of a lever 29 in radially opening bores in it. When thus rotated, the axles, by reason of their symmetrical arrangement, displace one roller 19b or 19c upwardly and the other downwardly. Since only small slant positions can be established—maximum about 1 mm.—the parameters of the mechanism (eccentric, turning range, radius of the gear sector, worm pitch, etc.) can be so calculated and arranged that with one rotation of the worm 26 the rollers 19b, 19c are displaced about 0.1 mm. If the drum 28 contains ten divisions, the operator can accomplish adjustment of the slanting position in steps of about 0.01 mm.

I claim:

1. A hydraulically actuated machine comprising two parallel spaced apart multiple-acting cylinders having respective pistons connected with opposite end portions of a beam that has a predetermined orientation substantially transverse to the cylinder axes, and wherein the pistons must be constrained to move at equal rates through their extension strokes to maintain said orientation of the beam, said machine having two effectively separate sources of pressure fluid at substantially equal flow rates, one for each of said cylinders, and each of said cylinders having at a blind end thereof a blind end chamber into which pressure fluid is fed for extension of its piston and at a rod end thereof a rod end chamber into which pressure fluid is fed for retraction of its piston, said machine being characterized by:

A. each cylinder having a coaxial projection therein that extends into a well in its piston and defines an inner chamber within the piston into which pressure fluid can be fed to impose an extending force upon the piston, the blind end chamber in the cylinder being annular and in surrounding relation to said coaxial projection;

B. bifurcated duct means for each cylinder, each said duct means having (1) a common portion connected with the pressure fluid source for the cylinder and (2) a pair of branch portions, (a) one of which is connected with the inner chamber of the cylinder and (b) the other of which is connected with the blind end chamber of the cylinder;

C. means connecting the rod end chamber of each cylinder in feedback relation to the pressure fluid source for the other cylinder so that during the extension strokes of the pistons fluid expelled from the rod end chamber of each cylinder augments the supply of fluid fed to the blind end chamber of the other cylinder;

D. a two-condition valve for each cylinder, each said two-condition valve being connected in said other branch portion of the bifurcated duct means for the cylinder and being shiftable between (1) a closed condition blocking flow of fluid from the pressure fluid source for the cylinder to the blind end chamber of the cylinder, so that pressure fluid can flow only to the inner chamber, for rapid extension of the piston, and (2) an open condition permitting flow of pressure fluid from said source to the blind end chamber as well as the inner chamber, for slower and more forceful extension of the piston;

E. a pair of synchronizing valves, one for each cylinder, each having a metering valve element which is progressively movable between a closed position and a fully open position;

F. means connecting the synchronizing valve for each cylinder between said common portion of the bifurcated duct means for the cylinder and a vent outlet, to provide for venting of pressure fluid flowing towards said branch portions at a rate that increases with increasing displacement of said metering valve element towards said open position; and G. a pair of sensor means, one for each synchronizing valve, each said sensor means being connected with an end portion of the beam to which the cylinder for its synchronizing valve is connected and being arranged to displace the metering valve element of its synchronizing valve towards its open position substantially proportionally to displacement of its end of the beam away from said orientation in the direction of piston extension.

2. The hydraulically actuated machine of claim 1, further characterized by:

H. stop control means comprising an element which is constrained to move with said beam and which is operatively associated with the metering valve elements of the synchronizing valves for moving said metering valve elements towards their open positions as the beam approaches a predetermined stop position during movement in the direction of piston extension.

3. The hydraulically actuated machine of claim 1, further characterized by:

E. a cut-off valve for each cylinder, each said cut-off valve (1) being connected in said common portion of the bifurcated duct means for its cylinder and (2) being arranged to permit flow of fluid from the pressure fluid source for its cylinder to the branch portions of the bifurcated duct means for its cylinder only when pressure of fluid in said common portion exceeds a predetermined value; and F. said means connecting the rod end chamber for each cylinder in feedback relation to the pressure fluid source for the other cylinder being connected to said common portion for that other cylinder, between the pressure fluid source for that other cylinder and the cut-off valve for that other cylinder.

4. A hydraulically actuated machine comprising two parallel, spaced apart multiple-acting cylinders having respective pistons connected with opposite end portions of a beam that has a predetermined orientation substantially transverse to the cylinder axes, and wherein the pistons must be constrained to move at equal rates through their extension strokes to maintain said orientation of the beam, said machine having two effectively separate sources of pressure fluid at substantially equal flow rates, one for each of said cylinders, and each of said cylinders having at a blind end thereof blind end chamber means into which pressure fluid is fed for extension of its piston and at a rod end thereof a rod end chamber into which pressure fluid is fed for retraction of its piston, said machine being characterized by:

A. duct means for each cylinder, for connecting the pressure fluid source for the cylinder with the blind end chamber means of the cylinder;

B. feedback means for connecting the rod end chamber of each cylinder with the pressure fluid source for the other cylinder, so that during extension of the pistons fluid expelled from the rod end chamber of each cylinder augments the supply of fluid to the blind end chamber means of the other cylinder;

C. a synchronizing valve for each cylinder, each connected with said duct means for its cylinder for venting the same at a controllably variable rate; and D. a pair of sensor elements, one for each synchronizing valve, each connected with an end portion of the beam to detect departure thereof in the direction of piston extension from said orientation of the beam, each sensor element being operatively associated with its synchronizing valve to cause the same to vent fluid at a rate substantially in proportion to the magnitude of such departure.

5. The machine of claim 4, further characterized by:

E. the blind end chamber means of each of said cylinders comprising (1) an inner chamber defined by a coaxial projection in the cylinder that extends into a well in its piston, said inner chamber having an effective cross-section area larger than that of said rod end chamber, and (2) an annular blind end chamber in surrounding relation to said projection;

F. valve means for each annular blind end chamber, providing for selectable alternative connection of that chamber (1) with the pressure fluid source for the cylinder, to provide for forceful extension of the piston, and (2) with an unpressurized fluid source, to provide for rapid extension and for retraction of the piston; and G. other valve means for each inner chamber, providing for selectable alternative connection of that chamber (1) with the pressure fluid source for the cylinder, to provide for piston extension, and (2) with said unpressurized fluid source, to provide for piston retraction.

6. The machine of claim 4, further characterized by:

E. stop control means comprising an element which is carried by said beam for movement therewith and operatively associated with said synchronizing valves to cause the same to vent fluid at an increasing rate as the beam approaches a predetermined stop position during its movement in the direction of piston extension.

7. The hydraulically actuated machine of claim 4, further characterized by:

(1) said duct means for each cylinder comprising a cut-off valve having an inlet connected with the pressure fluid source for the cylinder and an outlet connected with the blind end chamber means for the cylinder, said cut-off valve being arranged to be open only when pressure at its inlet exceeds a predetermined value, and (2) said feedback means for connecting the rod end chamber of each cylinder with the pressure fluid source for the other cylinder being connected with the inlet of the cut-off valve for that other cylinder.

* * * * *